United States Patent [19]

Fraser, Jr.

[11] Patent Number: 4,993,928

[45] Date of Patent: Feb. 19, 1991

[54] SCROLL COMPRESSOR WITH DUAL POCKET AXIAL COMPLIANCE

[75] Inventor: Howard H. Fraser, Jr., Lafayette, N.Y.

[73] Assignee: Carrier Corporation, Syracuse, N.Y.

[21] Appl. No.: 418,604

[22] Filed: Oct. 10, 1989

[51] Int. Cl.[5] ..... F04C 18/04

[52] U.S. Cl. ..... 418/55.4; 418/55.5; 418/57

[58] Field of Search ..... 418/55 C, 55 D, 57

[56] References Cited

U.S. PATENT DOCUMENTS

| | | | |
|---|---|---|---|
| 3,600,114 | 8/1971 | Dvorak et al. | 418/55.5 |
| 3,884,599 | 5/1975 | Young et al. | 418/55.5 |
| 3,924,977 | 12/1975 | McCullough | 418/55.5 |
| 3,994,633 | 11/1976 | Shaffer | 418/5 |
| 4,496,296 | 1/1985 | Arai et al. | 418/57 |
| 4,645,437 | 2/1987 | Sakashita et al. | 418/55.5 |
| 4,743,181 | 5/1988 | Murayama et al. | 418/55.5 |

FOREIGN PATENT DOCUMENTS

| | | | |
|---|---|---|---|
| 63-106388 | 5/1988 | Japan | 418/55.5 |

*Primary Examiner*—John J. Vrablik
*Attorney, Agent, or Firm*—David J. Zobkiw

[57] ABSTRACT

Two annular pressure pockets are used to push the orbiting scroll against the fixed scroll to minimize leakage. One pocket is at intermediate pressure and the other is at discharge pressure. The pockets are defined by the orbiting scroll and an axial ring carried by the orbiting scroll which permits the use of radial seals thereby essentially eliminating wear on the seals.

8 Claims, 2 Drawing Sheets

SCROLL COMPRESSOR WITH DUAL POCKET AXIAL COMPLIANCE

BACKGROUND OF THE INVENTION

In a scroll compressor the trapped volumes are in the shape of lunettes and are defined between the wraps or elements of the fixed and orbiting scrolls and their end plates. The lunettes extend for approximately 360° with the ends of the lunettes defining points of tangency or contact between the wraps of the fixed and orbiting scrolls. These points of tangency or contact are transient in that they are continuously moving towards the center of the wraps as the trapped volumes continue to reduce in size until they are exposed to the outlet port. As the trapped volumes are reduced in volume the ever increasing pressure acts on the wrap and end plate of the orbiting scroll tending to axially and radially move the orbiting scroll with respect to the fixed scroll.

Radial movement of the orbiting scroll away from the fixed scroll is controlled through radial compliance. Eccentric bushings, swing link connections and slider blocks have all been disclosed for achieving radial compliance. Each approach ultimately relies upon the centrifugal force produced through the rotation of the crankshaft to keep the wraps in sealing contact.

Axial movement of the orbiting scroll away from the fixed scroll produces a thrust force. The weight of the orbiting scroll, crankshaft and rotor may act with, oppose or have no significant impact upon the thrust force depending upon whether the compressor is vertical or horizontal and, if vertical, whether the motor is above or below the orbiting scroll. Also, the highest pressures correspond to the smallest volumes so that the greatest thrust loadings are produced in the central portion of the orbiting scroll but over a limited area. The thrust forces push the orbiting scroll against the crankcase with a large potential frictional loading and resultant wear. A number of approaches have been used to counter the thrust forces such as thrust bearings and a fluid pressure back bias on the orbiting scroll. Discharge pressure and intermediate pressure from the trapped volumes as well as an external pressure source have been used to provide the back bias. Specifically, U.S. Pat. Nos. 3,600,114, 3,924,977 and 3,994,633 utilize a single fluid pressure chamber to provide a scroll biasing force. This approach provides a biasing force on the orbiting scroll at the expense of very large net thrust forces at some operating conditions. As noted, above, the high pressure is concentrated at the center of the orbiting scroll but over a relatively small area. If the area of back bias is similarly located, there is a potential for tipping since some thrust force will be located radially outward of the back bias. Also, with the large area available on the back of the orbiting scroll, it is possible to provide a back bias well in excess of the thrust forces.

SUMMARY OF THE INVENTION

An axial ring is provided which coacts with the back of the orbiting scroll to form two annular fluid pressure chambers for providing a back bias to the orbiting scroll. Preferably the inner annular chamber is at discharge pressure and the outer annular chamber is at an intermediate pressure. This arrangement locates the discharge chamber and the greatest back bias opposite the greatest thrust force. A wider operating envelope is possible because the dual pocket configuration allows for a smaller range of thrust forces than a single pocket configuration and thereby provides a more stable arrangement. The annular axial ring is carried by the orbiting scroll so that there is no relative radial movement between the members defining the annular chambers. As a result, radial seals can be employed which essentially eliminate wear on the seals. Thus, the present invention provides a smaller range of net thrust forces throughout the operating envelope and is therefore at least as efficient as known designs while avoiding seizure at the scroll tips and excessive wear due to excessive thrust forces.

It is an object of this invention to provide a wider and more stable operating envelope.

It is another object of this invention to improve axial compliance over the entire operating envelope.

It is a further object of this invention to minimize thrust losses on the back face of the orbiting scroll.

It is an additional object of this invention to provide a radial seal to thereby decrease seal friction and tolerance sensitivity in the axial direction. These objects, and others as will become apparent hereafter, are accomplished by the present invention.

Basically, two pressure pockets are created to push the orbiting scroll against the fixed scroll to minimize leakage. One pocket is at intermediate pressure and the other is at discharge pressure. The pockets are defined between an axial ring which moves with the orbiting scroll and the orbiting scroll so that radial seals can be used with no relative movement between the parts defining the pockets during operation.

BRIEF DESCRIPTION OF THE DRAWINGS

For a fuller understanding of the present inventions, reference should now be made to the following detailed description thereof taken in conjunction with the accompanying drawings wherein.

DESCRIPTION OF THE PREFERRED EMBODIMENT

Figure 1:
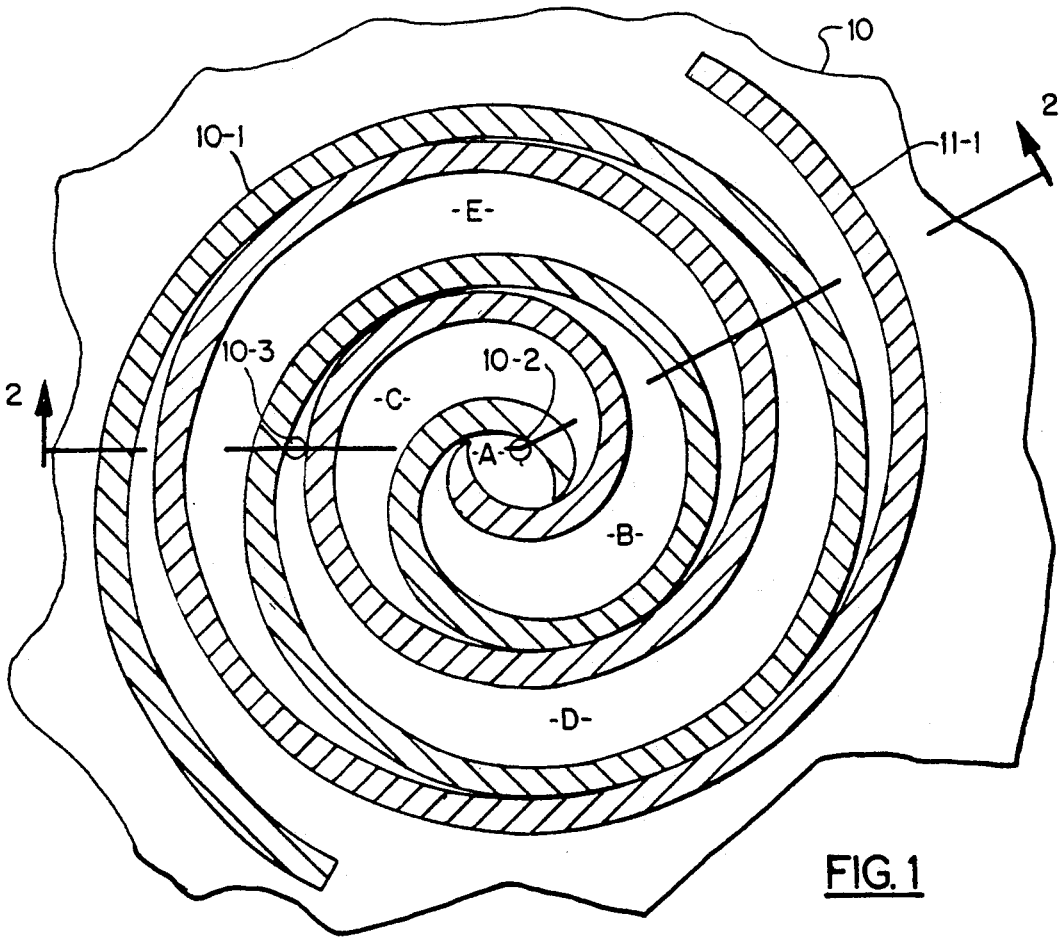
FIG. 1 is a sectional view of the fixed and orbiting scroll of a scroll compressor taken along line 1—1 of FIG. 2.
Figure 2:
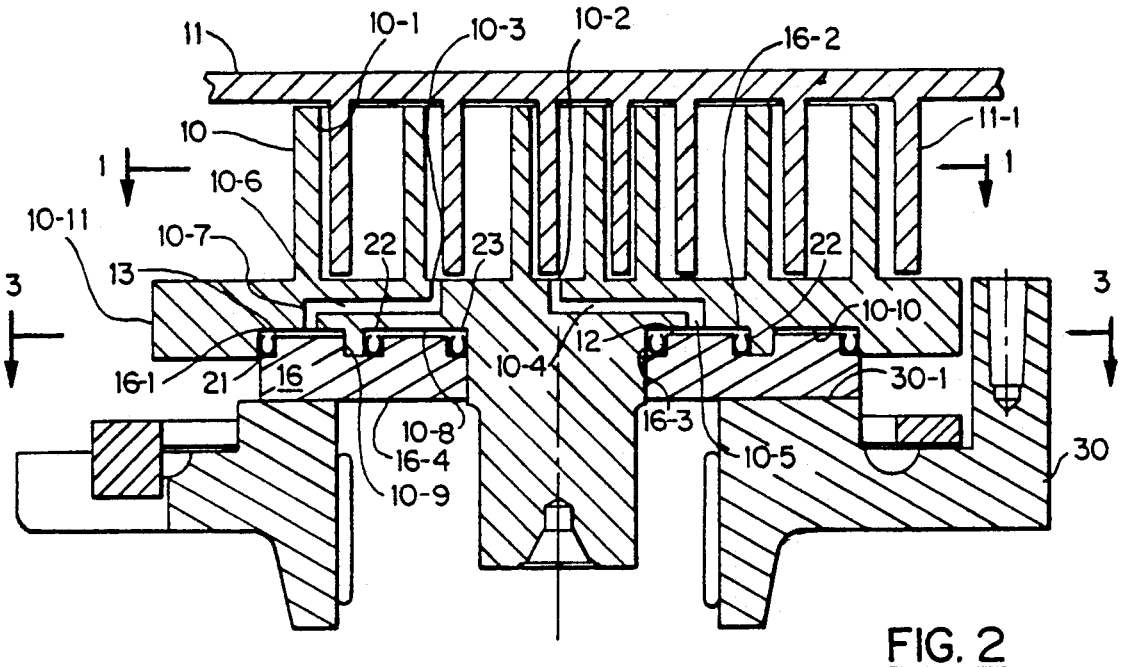
FIG. 2 is a sectional view taken along line 2—2 of FIG. 1.
Figure 3:
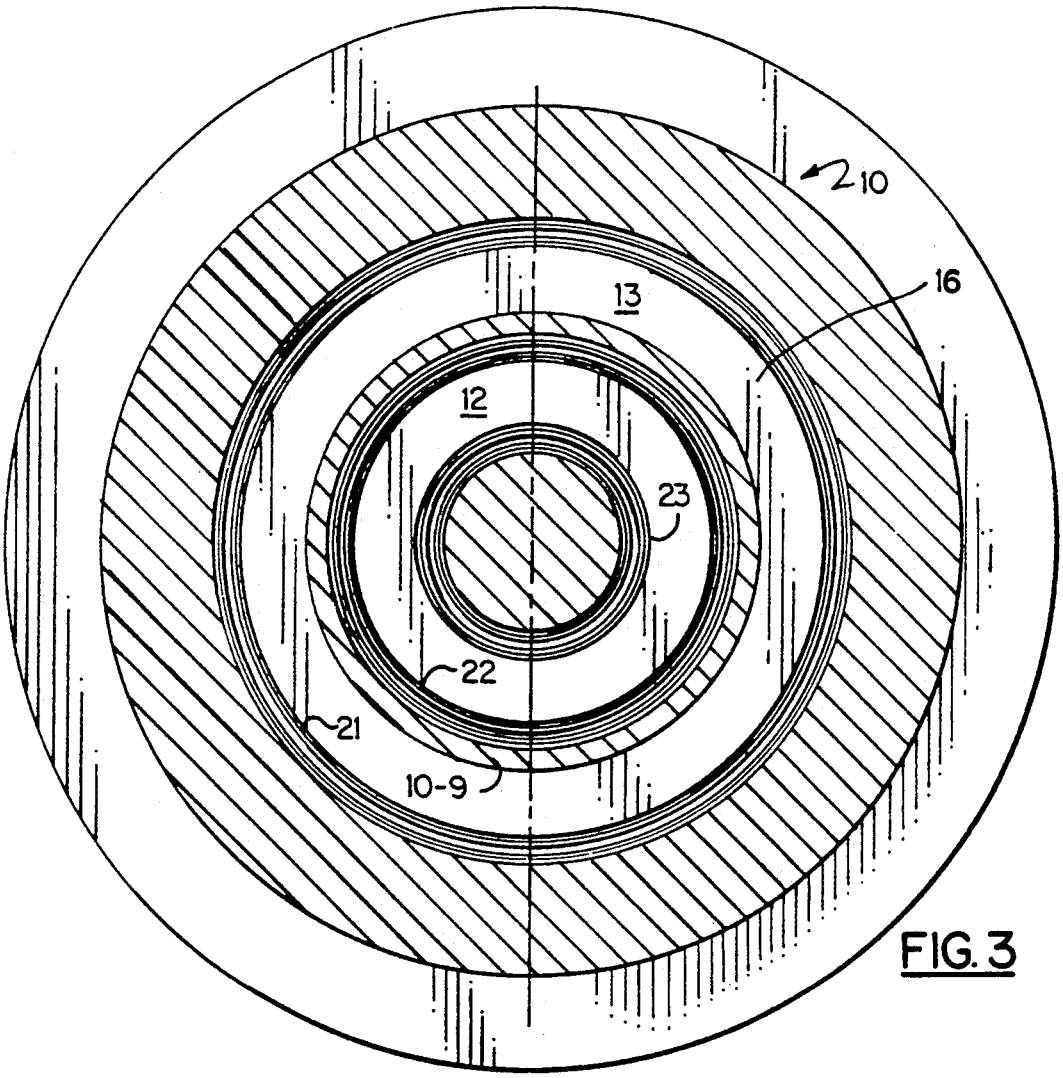
FIG. 3 is a sectional view taken along line 3—3 of FIG. 2.

In FIG. 1, the numeral 10 generally designates the orbiting scroll of a scroll compressor. Orbiting scroll 10 has wrap 10-1 and an inner axial bore 10-2 and an outer axial bore 10-3. Referring now to FIG. 2, it will be noted that bore 10-2 is in fluid communication with annular pocket or chamber 12 via radial bore 10-4 and axial bore 10-5. Similarly, bore 10-3 is in fluid communication with annular pocket or chamber 13 via radial bore 10-6 and axial bore 10-7. Axial ring 16 coacts with the plate portion 10-11 of orbiting scroll 10 to define radially spaced annular pockets or chambers 12 and 13. Specifically, orbiting scroll 10 has an inner annular recess 10-8 partially defining chamber 12, an outer annular recess 10-10 partially defining chamber 13 with an axial annular projection 10-9 separating recesses 10-8 and 10-10. Axial ring 16 is received in recesses 10-8 and, 10-10 to partially define chambers 12 and 13 and is movable with orbiting scroll 10. Axial ring 16 has an outer annular shoulder 16-1, an inner annular shoulder 16-3 and intermediate annular recess 16-2. Annular radial seal 21 is located on annular shoulder 16-1 and sealingly engages the outer wall of recess 10-10. Annular radial seal 22 is located in annular recess 16-2 as is annular projection 10-9 which coacts therewith to provide a fluid seal. Annular radial seal 23 is located on annular shoulder 16-3 and sealingly engages the inner wall of recess 10-8. The relationship of chambers 12 and 13 as well as that of seals 21-23 is best illustrated in FIG. 3 which clearly shows that chamber 13 is defined in part by seal 21, axial ring 16 and annular projection 10-9 while chamber 12 is defined in part by seal 22, axial ring 16 and seal 23. The rear or bottom face 16-4 of axial ring 16 engages surface 30-1 of crankcase 30 in a thrust relationship with axial ring 16 orbiting with respect to surface 30-1.

Figure 4:
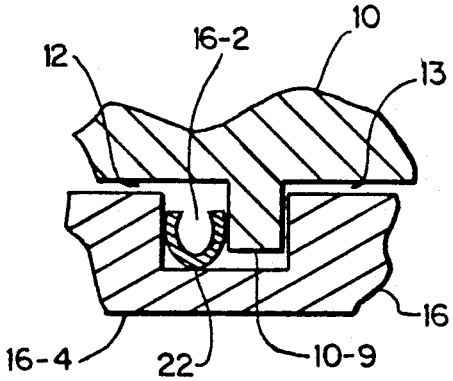
FIG. 4 is an enlarged sectional view of the sealing structure.

Referring now specifically to FIG. 4, it will be noted that annular projection 10-9 is of a lesser axial extent than the depth of annular recess 16-2. Sealing between chambers 12 and 13 is achieved by annular radial seal 22 which is forced against the inner wall and bottom of annular recess 16-2 and the inner wall of annular projection 10-9 by the pressure in chamber 12 as well as the resiliency of radial seal 22. Similarly, the pressure in chamber 13 as well as the resiliency of radial seal 21 causes seal 21 to seal against the bottom and side of shoulder 16-1 as well as the outer wall of recess 10-10. The pressure in chamber 12 as well as the resiliency of radial seal 23 causes seal 23 to seal against the bottom and side of shoulder 16-3 as well as the inner wall of recess 10-8.

In operation, as orbiting scroll 10 is driven by the crankshaft (not illustrated), it carries axial ring 16 through its orbital movement so that there is, in general, no relative movement between orbiting scroll 10 and axial ring 16. As wrap 10-1 of orbiting scroll 10 coacts with wrap 11-1 of the fixed scroll 11 to establish and compress trapped volumes of gas, A-E, gas in the trapped volume D which is exposed to bore 10-3 is communicated to chamber 13 while gas in the trapped volume A which is exposed to bore 10-2 and the outlet (not illustrated) in fixed scroll 11 is communicated to chamber 12. Since bore 10-3 is located at an intermediate point in the compression process while bore 10-2 is located in the vicinity of the outlet, chamber 12 is nominally at discharge pressure while chamber 13 is at an intermediate pressure. The pressures in chambers 12 and 13 act against orbiting scroll 10 to keep it in engagement with the fixed scroll 11 to thereby minimize leakage at the tips of the wraps 10-1 and 11-1. The pressures in chambers 12 and 13 also act against axial ring 16 to force it against surface 30-1 of crankcase 30. This combination of axial forces may cause axial ring 16 and seals 21-23 to be moved axially at start up and shutdown but the movement will be relatively small. Because axial ring 16 moves with orbiting scroll 10 and is forced against surface 30-1, any wear will tend to take place between these two members but such wear will be minimized through proper lubrication.

Although chamber 13 has been described as being at intermediate pressure and chamber 12 at discharge pressure, bore 10-4 could be relocated so as to communicate bores 10-2 and 10-7 and bore 10-6 can similarly be relocated to communicate bores 10-3 and 10-5. This would result in discharge pressure being supplied to chamber 13 and intermediate pressure being supplied to chamber 12. While intermediate pressure is generally less than discharge pressure it is not necessarily true during all operating conditions and therefore just describes an intermediate point during the compression process. Specifically, the pressures achieved during the compression process depend upon a number of factors such as the mass being compressed and leakage. Thus, under some conditions, over compression can take place such that the intermediate pressure is greater than the discharge pressure since the discharge pressure is influenced by the system downstream of the discharge rather than, solely, the pressure delivered to the discharge from the compression process.

From the foregoing description, it should be clear that there is an improved axial compliance over the entire operating envelope because of the relatively large total radial extent and areas of pockets 12 and 13 and because they are responsive to two pressures in the compression process. The seal design is such that there is little if any movement relative to the seals which decreases seal wear and axial sensitivity.

Although a preferred embodiment of the present invention has been illustrated and described, other changes will occur to those skilled in the art. It is therefore intended that the scope of the present invention is to be limited only by the scope of the appended claims.

What is claimed is:

1. In a scroll compressor including a crankcase and a fixed scroll means, axial compliance means comprising:
   - an orbiting scroll means having a plate with a wrap on a first side and annular recess means on a second side;
   - annular ring means having a first side coacting with said annular recess means to define a plurality of radially spaced annular pocket means and a second side adapted to coact with said crankcase;
   - a plurality of fluid pressure supply means for supplying pressurized fluid to said pocket means at lest one of said fluid pressure supply means being from at least one trapped volume formed between sasid fixed and orbiting scroll means whereby fluid pressure supplied to said pocket means acts on said orbiting scroll means to keep said orbiting scroll means in axial engagement with said fixed scroll means and acts on said annular ring means to force said annular ring means against said crankcase and to thereby support said annular ring means and said orbiting scroll means.

2. The axial compliance means of claim 1 wherein said pocket means are sealed by radial seals.

3. The axial compliance means of claim 1 wherein said annular ring means moves with said orbiting scroll means.

4. An axial compliance means for a scroll compressor including fixed and orbiting scroll means and crankcase means, said axial compliance means comprising:
   - said oribiting scroll means having a plate with a wrap on a first side and a pair of radially spaced recesses on a second side;
   - annular ring means having a first side coacting with said pair of radially spaced recesses to define a pair of annular pocket means and a second side adapted to coact with said crankcase means;
   - first fluid pressure supply means for supplying fluid pressure to a first one of said pair of annular pocket means;
   - second fluid pressure supply means for supplying fluid pressure to a second one of said pair of annular pocket means;

whereby fluid pressure supplied to said pair of annular pocket means acts on said orbiting scroll means to keep said orbiting scroll means in axial engagement with said fixed scroll means and acts on said annular ring means to force said annular ring means against said crankcase means and to thereby support said annular ring means and said orbiting scroll means.

5. The axial compliance means of claim 4 wherein said pocket means are sealed by radial seals.

6. The axial compliance means of claim 4 wherein said annular ring means moves with said orbiting scroll means.

7. The axial compliance means of claim 4 wherein said first fluid pressure supply means supplies discharge fluid pressure and said second fluid pressure supply means supplies intermediate fluid pressure.

8. The axial compliance means of claim 7 wherein said first and second fluid pressure supply means are in fluid communication with trapped volumes defined between said fixed and orbiting scroll means.

* * * * *